US011083947B1

(12) United States Patent
Maina

(10) Patent No.: US 11,083,947 B1
(45) Date of Patent: Aug. 10, 2021

(54) ATHLETE TRAINING DEVICE

(71) Applicant: Ryan Maina, Louisville, KY (US)

(72) Inventor: Ryan Maina, Louisville, KY (US)

( * ) Notice: Subject to any disclaimer, the term of this patent is extended or adjusted under 35 U.S.C. 154(b) by 0 days.

(21) Appl. No.: 17/149,972

(22) Filed: Jan. 15, 2021

(51) Int. Cl.
*A63B 69/00* (2006.01)
*A63B 69/36* (2006.01)
*A63B 102/32* (2015.01)

(52) U.S. Cl.
CPC ..... *A63B 69/0086* (2013.01); *A63B 69/002* (2013.01); *A63B 69/0091* (2013.01); *A63B 69/3608* (2013.01); *A63B 69/3621* (2020.08); *A63B 2102/32* (2015.10); *A63B 2243/0025* (2013.01)

(58) Field of Classification Search
CPC ..... A63B 69/0086; A63B 69/0091; A63B 69/3621; A63B 69/3608; A63B 69/002; A63B 2243/0025; A63B 2102/32
USPC ..... 473/424
See application file for complete search history.

(56) References Cited

U.S. PATENT DOCUMENTS 1,753,310 A * 4/1930 Costello ..... A63B 69/0086 473/424
4,121,829 A * 10/1978 Petrusek ..... A63B 69/0086 473/576
4,247,117 A * 1/1981 Reichert ..... A63B 69/0086 473/424
5,591,089 A * 1/1997 Huffines ..... A63B 69/3608 273/DIG. 19
5,951,414 A * 9/1999 Sowards ..... A63B 69/0091 473/423
6,152,838 A * 11/2000 Killion ..... A63B 43/007 473/424
6,152,865 A * 11/2000 Beauvoir ..... A63B 69/0059 482/140
6,168,539 B1 * 1/2001 Maina ..... A63B 43/007 473/424
2013/0053188 A1 * 2/2013 Moore ..... A63B 69/0091 473/423
2014/0329622 A1 * 11/2014 Marshall ..... A63B 69/002 473/424
2017/0084194 A1 * 3/2017 Dawson ..... A63B 1/00

* cited by examiner

*Primary Examiner* — Nini F Legesse

(74) *Attorney, Agent, or Firm* — Duncan Galloway Egen Greenwald PLLC; Theresa Camoriano; Guillermo Camoriano

(57) ABSTRACT

An athlete training device has one end adapted to be in contact with the athlete's body. The other end of the device is adapted to be secured to an athletic device, such as a ball or a golf club head. The level of difficulty readily may be adjusted from a relatively easy configuration to progressively more difficult configurations.

12 Claims, 12 Drawing Sheets

ATHLETE TRAINING DEVICE

BACKGROUND

The present invention relates to an athlete training device. It can be difficult for an athlete to learn proper balance. For example, a soccer player may want to learn how to bounce a soccer ball on his head, thigh, or shoulder while keeping control of the ball, or a golfer may want to learn how to swing a golf club properly. The athlete may practice repeatedly to learn to do these things, but it would be easier if there were a device to help the athlete learn gradually, with increasing levels of difficulty as proficiency improves, similar to using training wheels on a bicycle.

SUMMARY

The present invention provides an athlete training device that helps the athlete learn to perform a task, with the task being made easier at the beginning and then gradually increasing in difficulty as the athlete's proficiency improves. In one embodiment, it can be used to teach a ball handler, such as a soccer player, how to balance a ball while bouncing the ball on a body part such as head, thigh or shoulder. In another embodiment, it can be used to teach a golfer how to swing a club properly. One end of the training device is adapted to be in contact with the athlete. The other end of the training device is attached to an athletic device such as a ball or a golf club head. The device may readily be adjusted from relatively easy to progressively more difficult configurations.

DESCRIPTION

Figure 1:
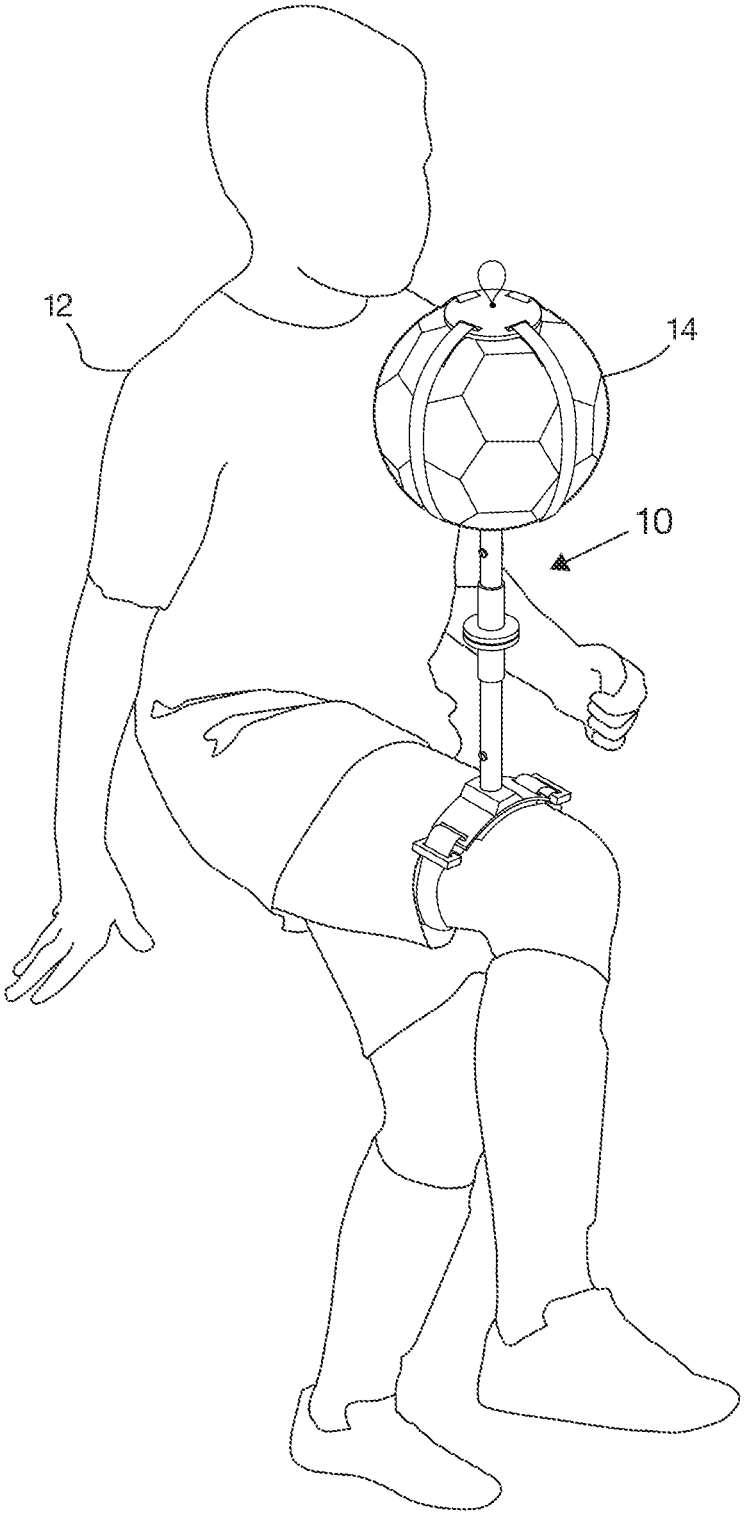
FIG. 1 is a perspective view of an athlete training device attached at one end to the thigh of an athlete.

FIG. 1 shows a first embodiment of an athlete training device 10, which has been attached to the right thigh of an athlete 12. In this case, the athlete is using the training device 10 to learn how to balance a soccer ball while he moves his leg up and down, bouncing the soccer ball 14 on his thigh.

Figure 2:
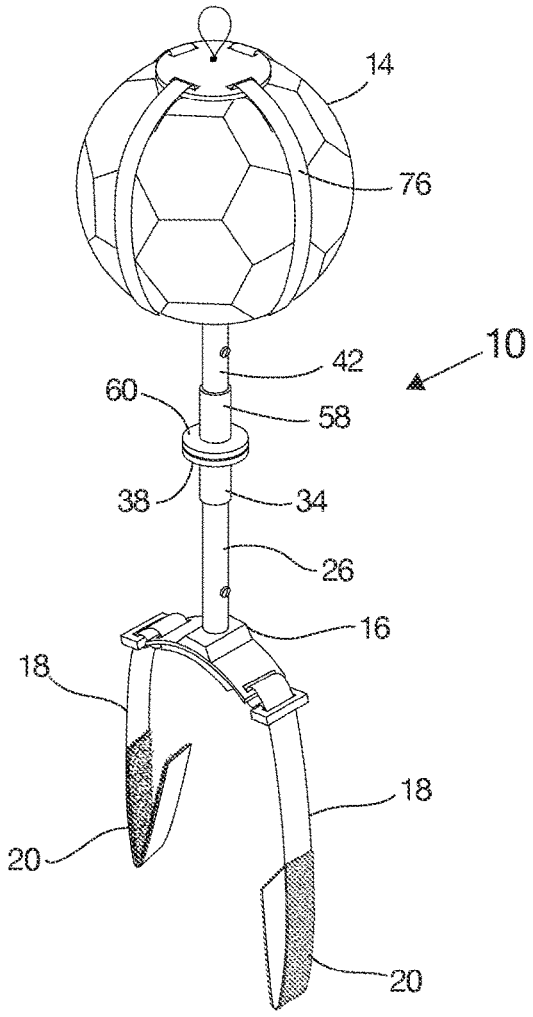
FIG. 2 is a perspective view of the athlete training device of FIG. 1.
Figure 3:
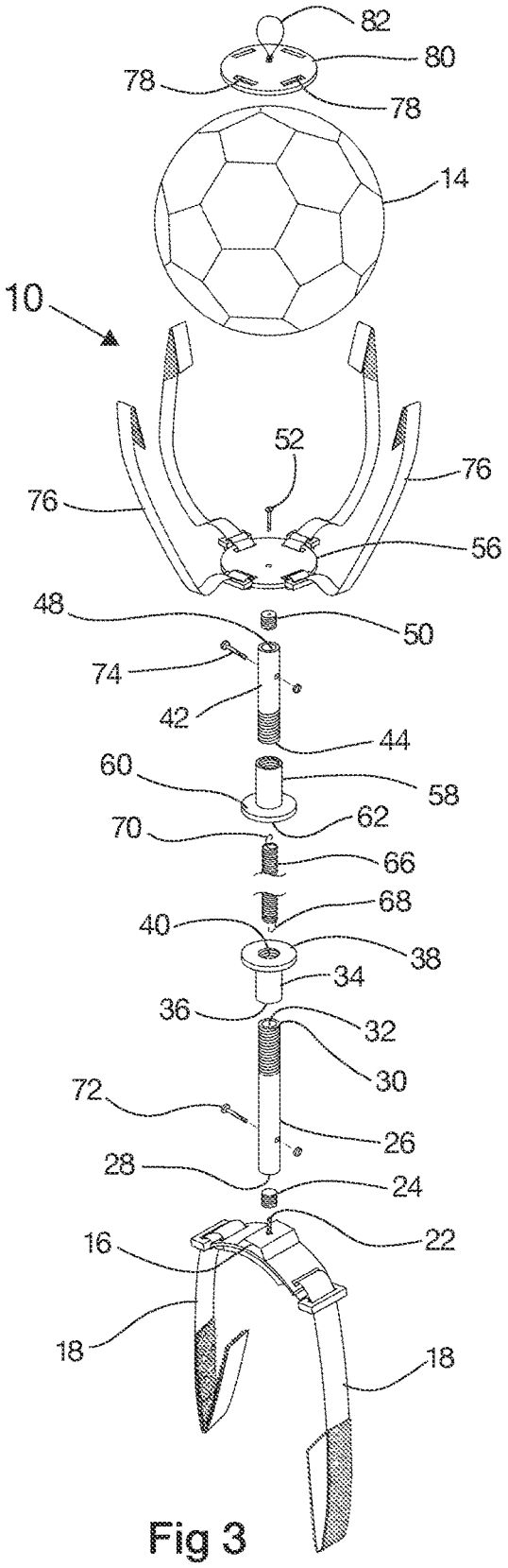
FIG. 3 is an exploded, perspective view of the athlete training device of FIG. 2.

Referring to FIGS. 2 and 3, the training device 10 includes a base 16 adapted to be temporarily secured to the athlete's body. In this embodiment, the base 16 includes an arched member with straps 18 which wrap around the athlete's thigh and then attach to each other by hook and loop fasteners 20. This base 16 may alternatively be attached to the athlete's head, shoulder, foot, or other body part.

A bolt 22 is fixed to the base 16 and projects upwardly from the base 16. An internally and externally threaded first cap 24 is threaded onto the bolt 22. A first hollow rod 26 has a proximal end 28 and a distal end 30. The first hollow rod 26 defines a first interior surface which is threaded at the proximal end 28. The first cap 24 is threaded into the internally-threaded proximal end of the first hollow rod 26 to secure the base 16 to the proximal end of the first hollow rod 26.

A first sleeve 34, having an internally threaded surface and having a flange 38 at its distal end 40 is threaded onto the externally threaded distal end 30 of the first hollow rod 26.

A second hollow rod 42, defining a second interior surface 48, has an externally-threaded proximal end 44 and an internally-threaded distal end 46. The distal end 46 of the second hollow rod 42 is secured to a cradle 56 for holding a ball 14 to be balanced by the athlete. An internally and externally threaded second cap 50 is threaded into the distal end 46 of the second hollow rod 42. A bolt 52 extends through the center of the cradle 56 and threads into the internal threads of the second cap 50 to fix the cradle 56 to the distal end 46 of the second hollow rod 42. It should be noted that in this embodiment the second hollow rod 42 is substantially shorter in length than the first hollow rod 26. In this particular embodiment, the first hollow rod 26 is 6 inches long, and the second hollow rod 42 is 4 inches long. Of course, the lengths may be selected by the designer in order to best carry out the desired training function for the particular athlete involved.

A second sleeve 58, defining an internally threaded surface and having a flange 60 at its proximal end 62, is threaded onto the externally threaded proximal end 44 of the second hollow rod 42.

The first and second flanges 38, 60 face each other.

An elastic member 66 extends coaxially along the interiors of the first and second hollow rods 26, 42. A proximal end 68 of the elastic member 66 is secured to the first hollow rod 26 by a through-bolt 72, and a distal end 70 of the elastic member 66 is secured to the second hollow rod 42 by a through-bolt 74. In this case, the elastic member 66 is a spring, but it alternatively could be a bungee cord or other type of elastic member.

Straps 76 extend through slots in the ball cradle 56, around the ball 14 and through slots 78 on a cover 80. The straps 76 have hook and loop fasteners that allow them to be tightened around the ball 14 to releasably secure the ball 14 in the ball cradle 56. While this embodiment shows a soccer ball being used, various balls of various sizes could be used. The cover 80 includes a finger loop 82, which may be used during certain exercises, such as the one shown in FIG. 7, as will be explained in more detail later.

The assembly of the training device 10 already has been described above, but is summarized below:

The first cap 24 is threaded into the proximal end 28 of the first hollow rod 26, and onto the bolt 22 projecting from the base 16 to secure the base 16 to the proximal end 28 of the first hollow rod 26.

The first sleeve 34 is threaded onto the distal end 30 of the first hollow rod 26.

The second cap 50 is threaded into the distal end 48 of the second hollow rod 42, and the ball cradle 56 is bolted into the second cap 50 by means of the bolt 52 to secure the ball cradle 56 to the distal end of the second hollow rod 42.

The second sleeve 58 is threaded onto the proximal end 44 of the second hollow rod 42.

The elastic member 66 is secured at its proximal end 68 inside the first hollow rod 26 by means of the through bolt 72. The distal end 70 of the elastic member 66 is fed out the distal end of the first hollow rod 26, through the first and second sleeves 34, 58 and into the proximal end 44 of the second hollow rod 42, and is secured inside the second hollow rod 42 by the through bolt 74.

The ball cradle 56 is bolted onto the second cap 50. The ball 14 is secured to the cradle 56 using the cover 80 and straps 76, while the base 16 of the training device 10 is secured to the athlete 12 using the straps 18.

Operation of the Training Device 10

Figure 4:
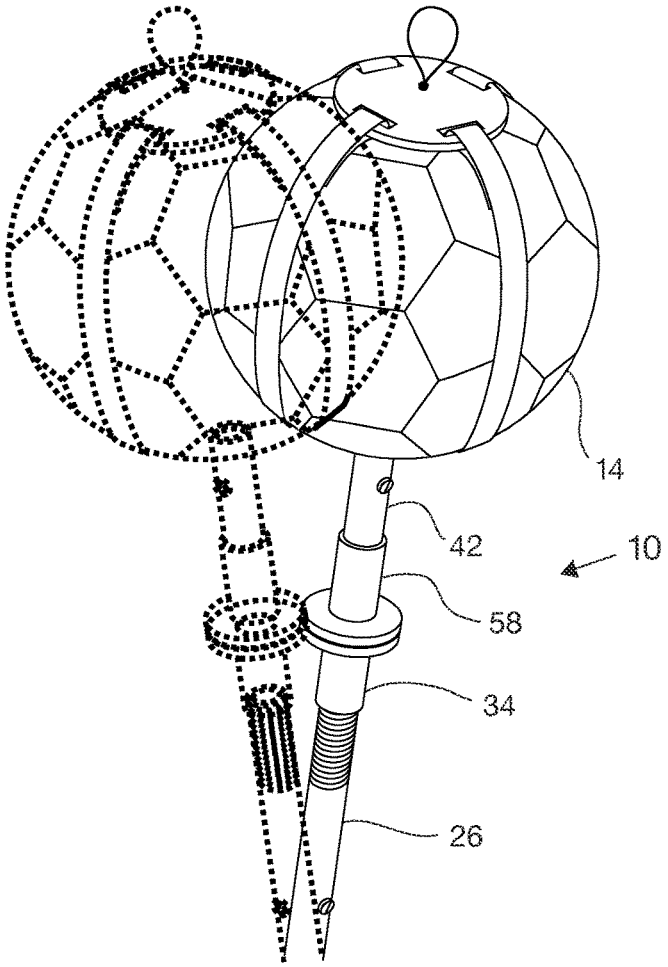
FIG. 4 is a broken away view of the training device of FIGS. 1-3 as it is being used by an athlete, with the second sleeve in a retracted position and the first sleeve in a bridging position.
Figure 4A:
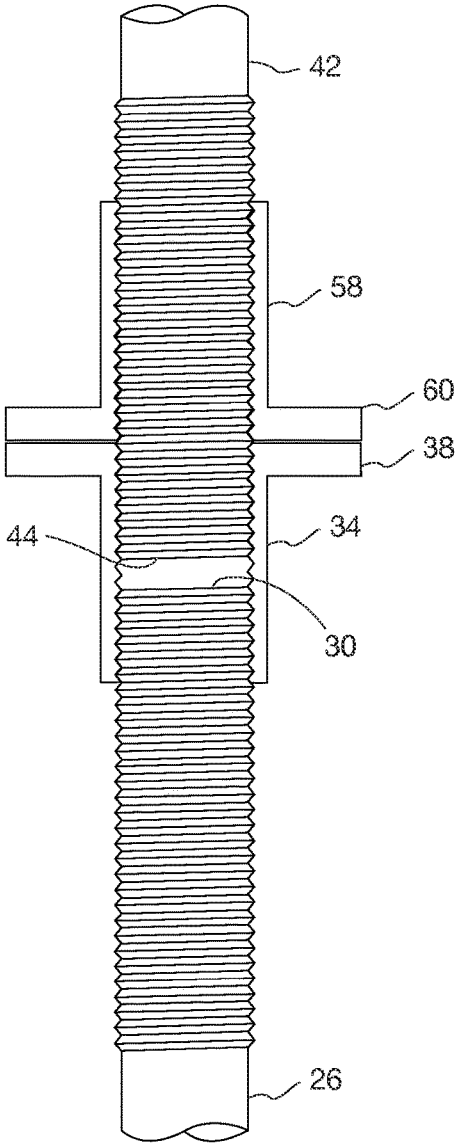
FIG. 4*a* is a broken-away, enlarged schematic sectional view of the arrangement of FIG. 4, with the elastic member removed for clarity.

The training device 10 has different operating modes depending upon its configuration. In a first, starter configuration, as seen in FIGS. 4 and 4*a*, the second sleeve 58 is threaded far enough onto the second hollow rod 42 to leave a substantial amount of the end of the second hollow rod 42 projecting beyond the flange 60. So, in this configuration, the second sleeve 58 is in a retracted position, being retracted away from the proximal end 44 of the second hollow rod 42. The first sleeve 34 is extended until it is threaded onto both the first and second hollow rods 26, 42, bridging across both of the hollow rods 26, 42 so as to rigidly connect the first and second hollow rods 26, 42 together to keep them axially aligned with each other, with no relative movement between the first and second hollow rods 26, 42. In this configuration, the first sleeve 34 is in a bridging position, while the second sleeve 58 is in a retracted position.

In this starter (bridged) configuration, as the athlete 12 moves his leg, the entire training device 10 moves as a unit, as shown in FIG. 4. The elastic member 66 does not come into play in this configuration. In this configuration, the athlete 12 has a relatively easy time of learning how to balance the ball 14, but he cannot bounce the ball 14 up and down.

It should be noted that a bridged configuration alternatively may be achieved by retracting the first sleeve 34 and extending the second sleeve 58 until the second sleeve 58 is threaded onto both hollow rods 26, 42 to bridge across both hollow rods and hold them in alignment with each other. (In this configuration, the second sleeve would be in the bridging position.)

Figure 5:
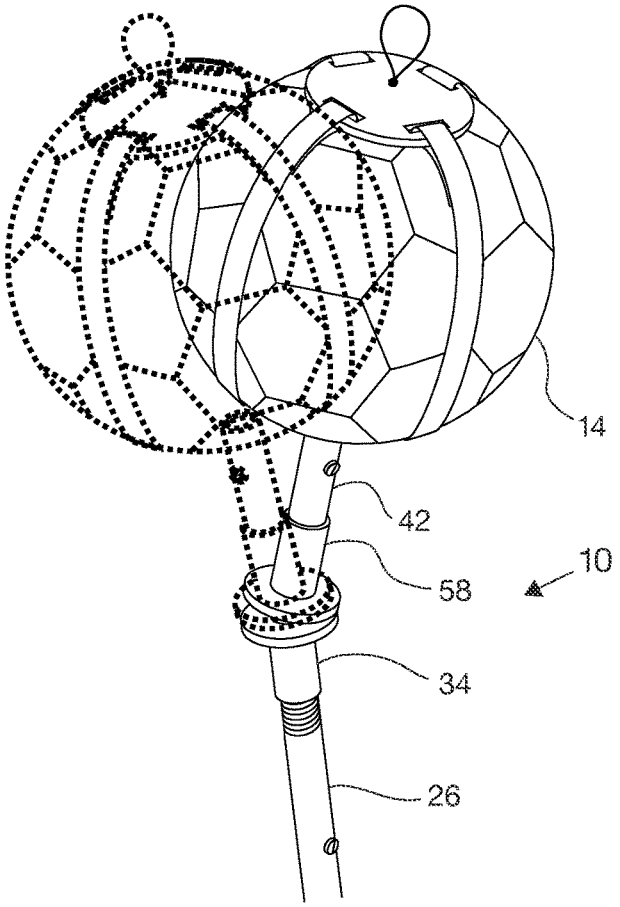
FIG. 5 is a view similar to FIG. 4, but with the first and second sleeves at the ends of their respective hollow rods with no bridging.
Figure 5A:
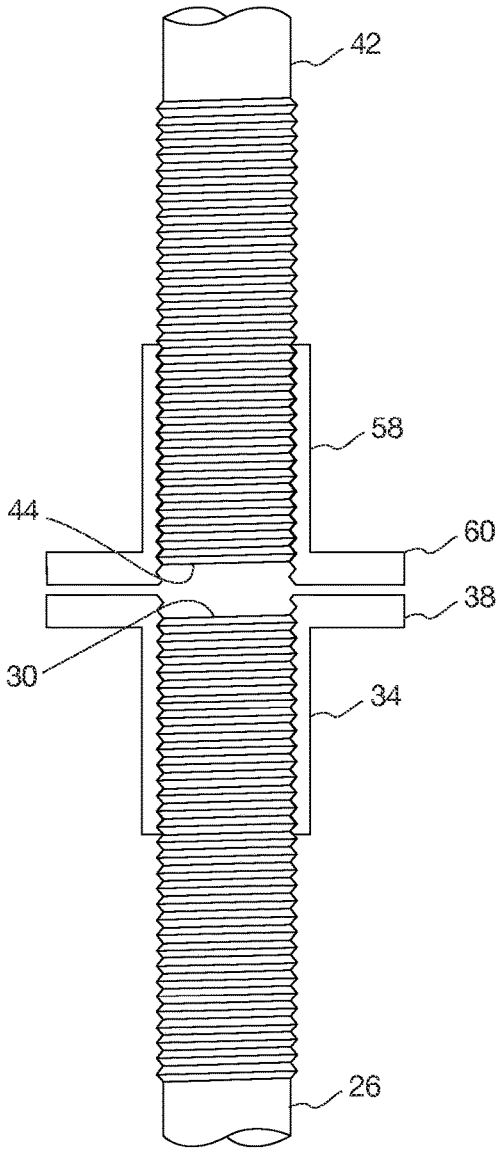
FIG. 5*a* is a broken-away, enlarged schematic sectional view of the arrangement of FIG. 5, with the elastic member removed for clarity.

In a second, intermediate-difficulty configuration, as seen in FIGS. 5 and 5*a*, the first sleeve 34 is threaded onto the first hollow rod 26 until the distal end 30 of the first hollow rod 26 is retracted slightly inside the first flange 38. Similarly, the second sleeve 58 is threaded onto the second hollow rod 42 until the proximal end 44 of the second hollow rod 42 is retracted slightly inside the second flange 60. In this configuration, the elastic member 66 comes into play and biases the two hollow rods 26, 42 towards each other while allowing the hollow rods 26, 42 to separate as the elastic member 66 is stretched. The first and second flanges 38, 60 face each other, and, when the first and second hollow rods 26, 42 are pulled together by the elastic member 66, the first and second flanges 38, 60 abut each other, providing a large surface area of contact which provides a relatively stable configuration that helps the athlete keep the ball 14 balanced. If the weight of the ball 14 goes too far out of balance, it will cause the second hollow rod 42 to tip out of axial alignment from the first hollow rod 26. However, even when this happens, the athlete does not have to spend time chasing the ball and can just put it back into alignment and start over again. It should be noted that the stiffer the elastic member 66, or the farther apart the ends of the elastic member are from each other, the more forcefully the elastic member 66 will bias the flanges 38, 60 together.

Figure 6:
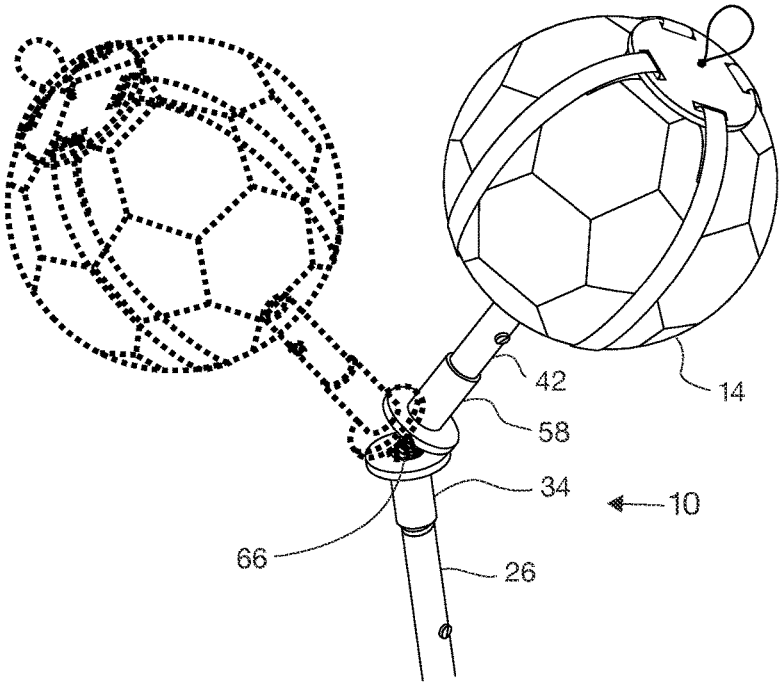
FIG. 6 is a view similar to FIG. 5, but with the first and second sleeves retracted.
Figure 6A:
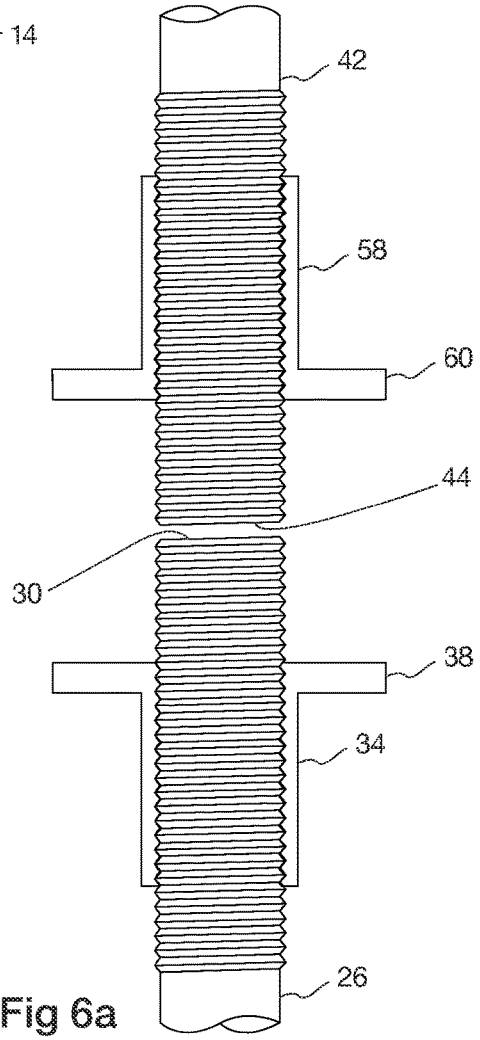
FIG. 6*a* is a broken-away, enlarged schematic sectional view of the arrangement of FIG. 6, with the elastic member removed for clarity.

FIGS. 6 and 6*a* show a more difficult training configuration. In this case, both the first and second sleeves 34, 58 are in a retracted position, with the ends of the first and second hollow rods 26, 42 projecting beyond the flanges 38, 60 of their respective sleeves 34, 58. In this configuration, the flanges 38, 60 do not come into play at all. When the athlete starts out, with the ball 14 in the balanced position, the two hollow rods 26, 42 are pulled together by the elastic member 66, and the distal end 30 of the first hollow rod 26 abuts the proximal end 44 of the second hollow rod 42. This provides a much smaller contact surface area, especially when compared with the relatively large contact surface area provided by the flanges 38, 60 of the previously described configuration. Due to the small size of this contact surface area, the aligned position for the two hollow rods 26, 42 is rather unstable, making it more difficult for the athlete to keep the ball balanced on the training device 10.

In each of the latter two configurations, the athlete may make an abrupt upward motion to cause the ball 14 to be tossed in the air, separating the first and second hollow rods 26, 42 from each other, and the athlete then may try to keep his leg aligned with the ball so that the first and second hollow rods 26, 42 remain in alignment as the ball 14 falls down and as the rods are pulled together by the elastic member 66.

Figure 7:
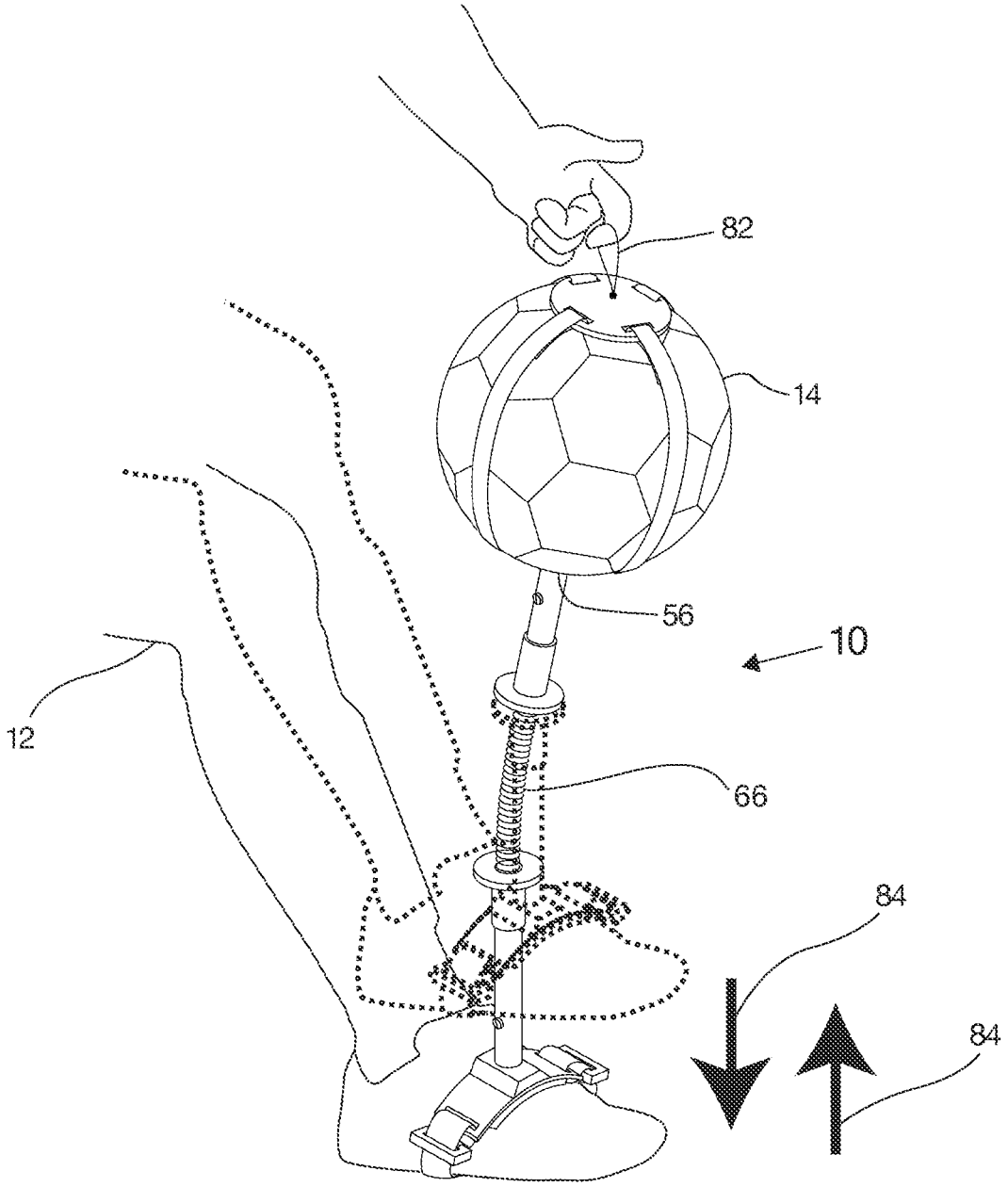
FIG. 7 is a view showing an athlete using the device of FIG. 2.

FIG. 7 shows the base of the training device 10 secured to the bridge of the athlete's foot instead of his thigh as shown in FIG. 1. In this exercise, the athlete 12 puts his finger through the loop 82 at the top of the ball 14 to control the position of the ball 14 and alternately raises and lowers his foot in the direction of the arrows 84 while holding the loop 82 in order to get a feel for what is required to balance the ball 14 on the training device 10.

Figure 8:
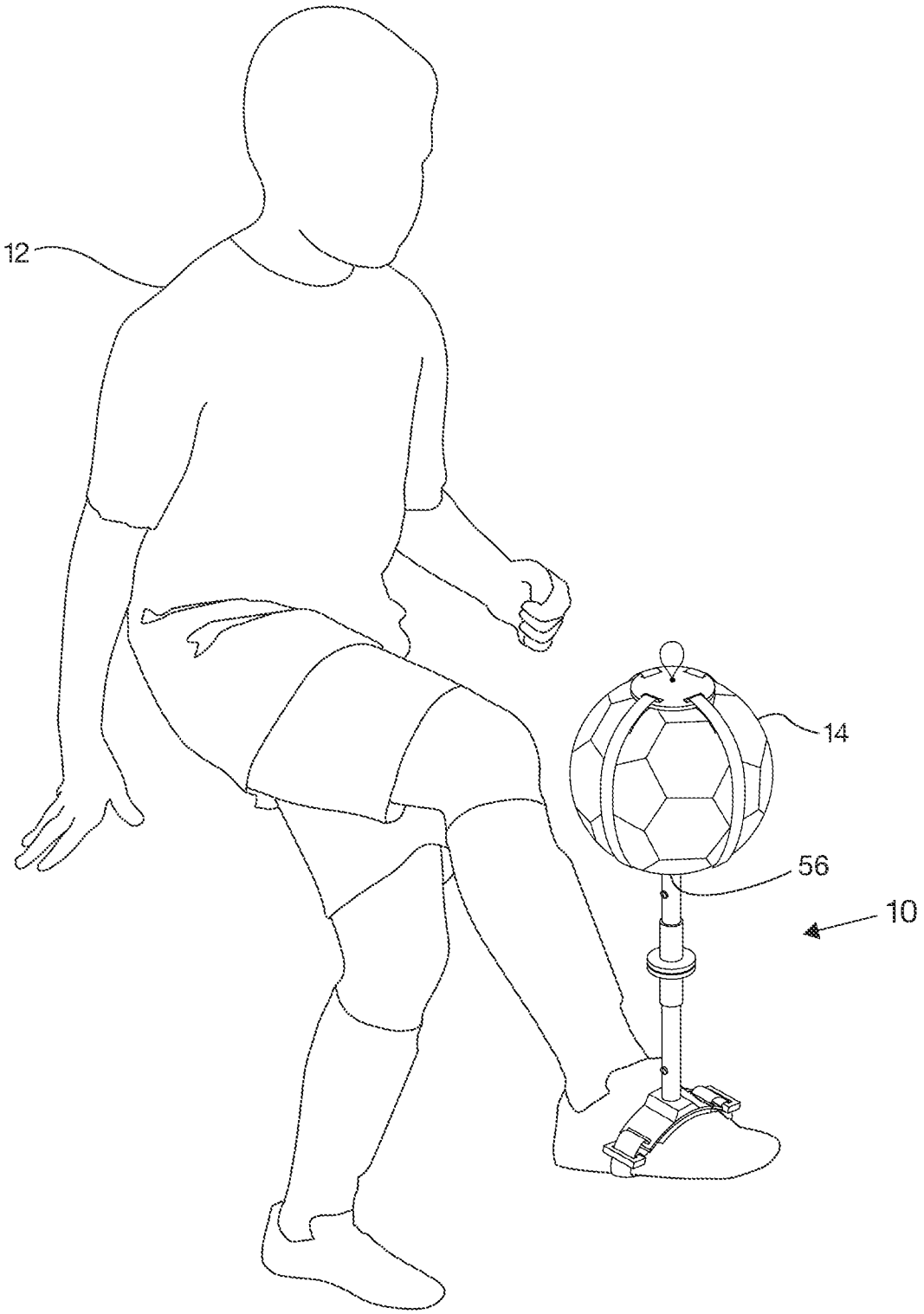
FIG. 8 is a perspective view of an athlete using the training device of FIG. 2 attached to the foot.

FIG. 8 shows the athlete 12 doing a very similar exercise to that shown in FIG. 7, except that he is no longer holding and guiding the ball 14. He has "graduated" to using only his foot to control the balance and movement of the ball.

Figure 9:
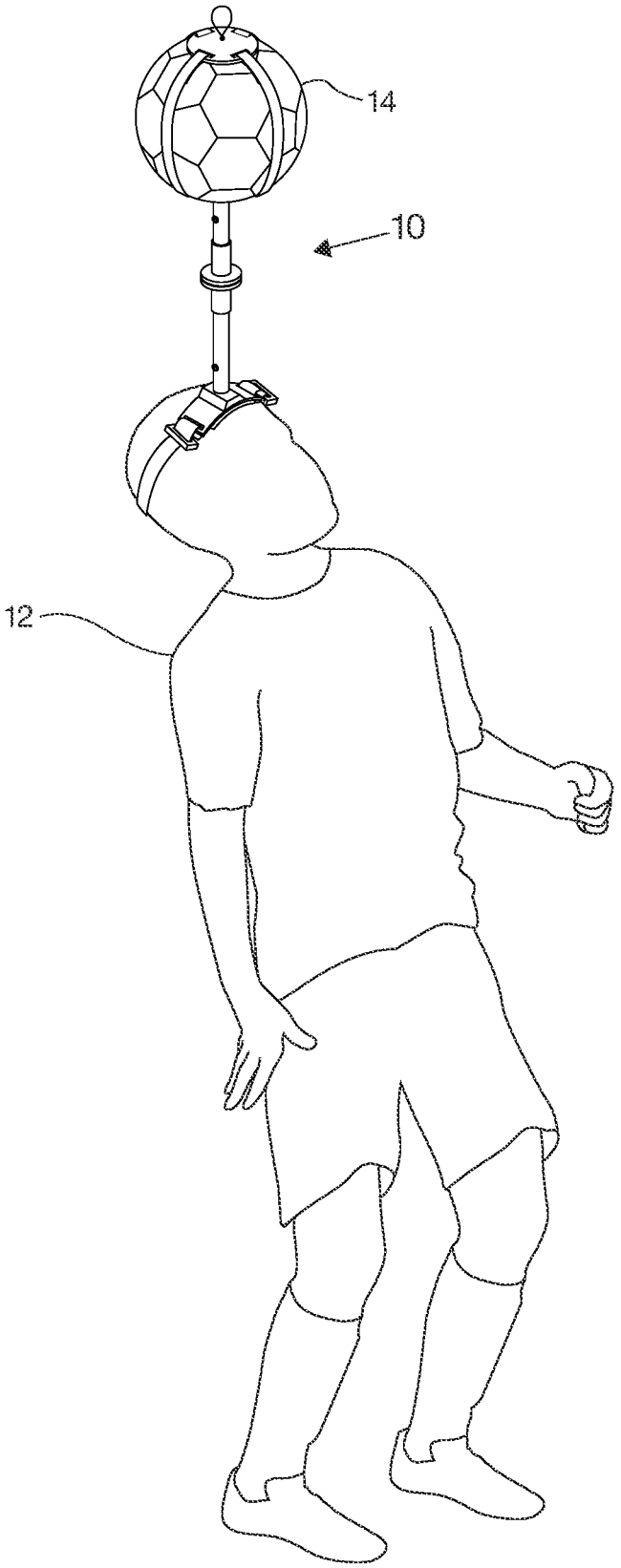
FIG. 9 is a perspective view of an athlete with the training device of FIG. 2 attached to the forehead.

In FIG. 9, the athlete 12 has strapped the base of the training device 10 to his forehead and is learning to balance the ball 14 on his head.

Figure 10:
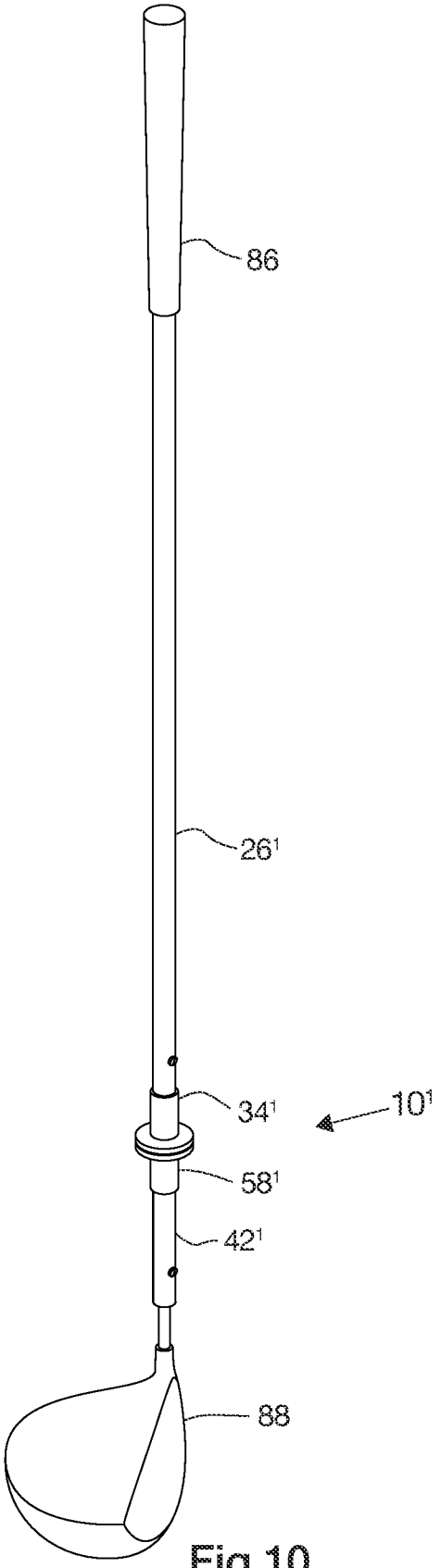
FIG. 10 is a perspective view of an alternative athlete training device in which the base is a golf club grip and the athletic device at the distal end is a golf club head.
Figure 11:
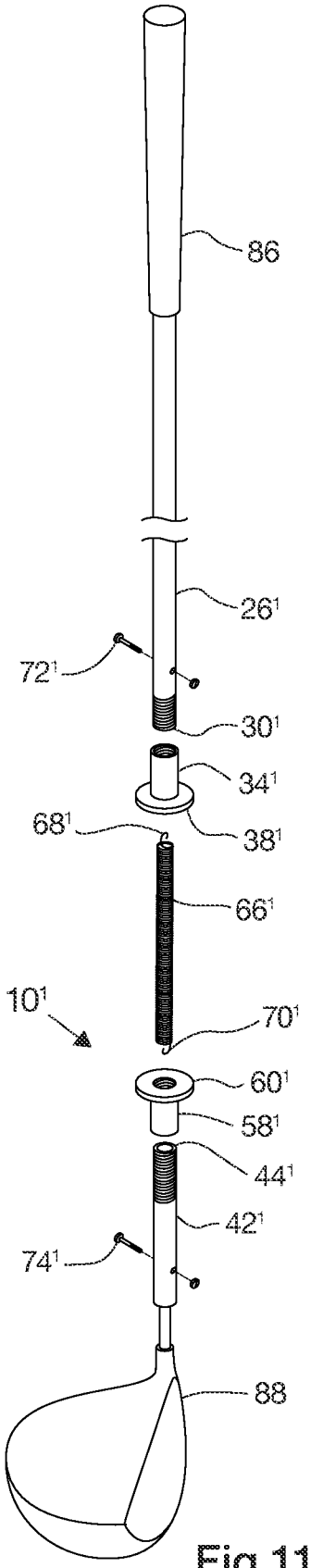
FIG. 11 is an exploded, perspective view of the training device of FIG. 10.
Figure 12:
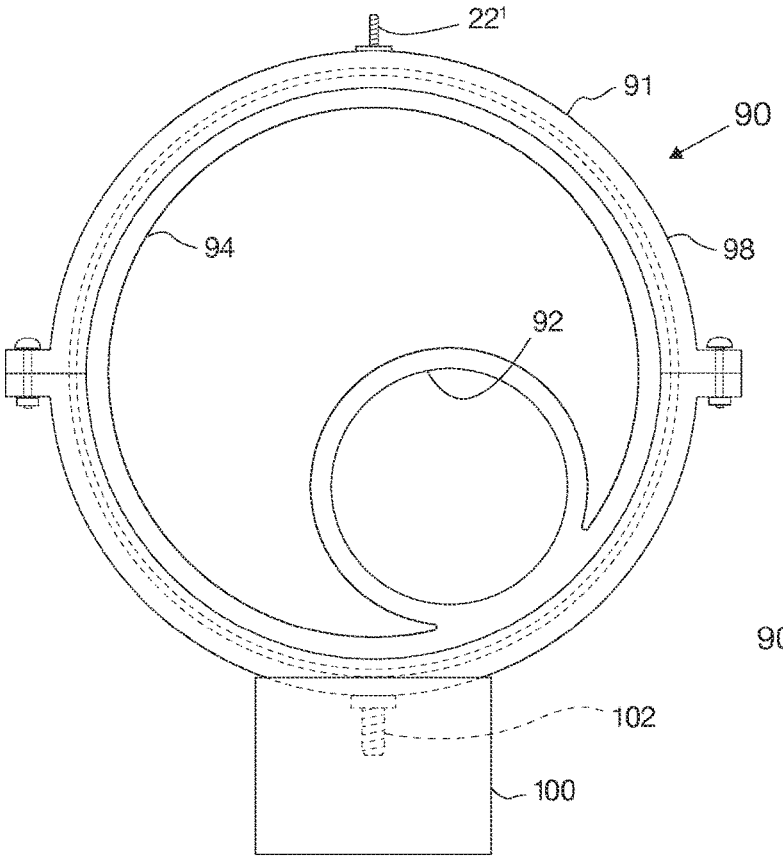
FIG. 12 is a front view of an alternative base to be attached to the training device of FIG. 2 so the athlete may practice a skill known as "around the world"
Figure 13:
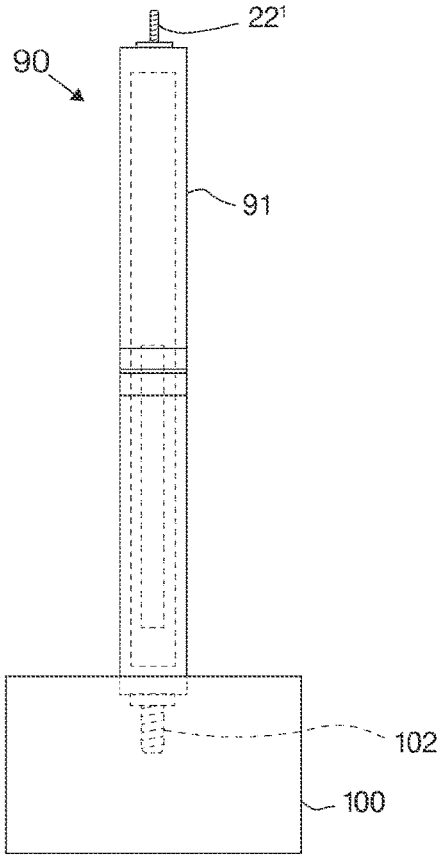
FIG. 13 is a side view of the base of FIG. 12.

FIGS. 10 and 11 show an alternative embodiment of an athlete training device 10' which is similar in its design and operation to the training device 10 described earlier, except that the base is a golf club grip 86, and the athletic device at the distal end is a golf club head 88. This training device 10' is intended to help the user learn how to swing his golf club and how to improve his swing. The base 86 is connected to the proximal end of a first hollow rod 26' having external threads at its distal end 30'. An internally-threaded first sleeve 34' having a flange 38' at its distal end is threaded onto the external threads of the first hollow rod 26'. A golf club head 88 is connected to the distal end of a second hollow rod 42' having external threads at its proximal end 44'. An internally-threaded second sleeve 58' having a flange 60' at its proximal end is threaded onto the external threads of the second hollow rod 42'. An elastic member 66' extends along the interior of the first and second hollow rods 26', 42' and is secured to the first and second hollow rods 26', 42' by through bolts 72', 74', respectively. As in the previous embodiment 10, the first hollow rod 26' is considerably longer than the second hollow rod 42'.

This device helps the athlete develop a proper golf club swing. If the athlete is swinging the club properly, the grip 86 and head 88 will remain in axial alignment. If not, then they will shift out of axial alignment.

This training device 10' also has a starter configuration, an intermediate configuration, and a difficult configuration as described with respect to the first device 10. That is, in the starter configuration one of the sleeves 34', 58' is threaded onto both the first and second hollow rods 26', 42', bridging across both hollow rods 26', 42' and holding them in alignment, with no relative motion between them.

In a second, intermediate-difficulty configuration, the sleeves 34', 58' are threaded onto their respective hollow rods 26', 42' to a point at which the respective ends of the hollow rods 26', 42' are slightly recessed into their respective sleeves 34', 58'. In this configuration, the elastic member 66' comes into play and biases the two hollow rods 26', 42' toward each other. As the hollow rods 26', 42' are pulled together by the elastic member 66', the relatively large flanges 38', 60' of their respective sleeves 34', 58' contact each other and guide the hollow rods 26', 42' into axial alignment.

Finally, in the most difficult configuration, the ends of the two hollow rods 26', 42' project beyond the flanges 38', 60' of their respective sleeves 34', 58'. In this configuration the flanges 38', 60' may not come into play at all, or come into play only marginally. When the two hollow rods 26', 42' come together, the distal end 30' of the first hollow rod 26' comes into contact with the proximal end 44' of the second hollow rod 42'. This is a relatively small contact surface area, especially when compared with the relatively large contact surface area provided by the flanges 38', 60' of the previously described configuration, which means that the athlete gets less help from the configuration in bringing the first and second hollow rods 26', 42' into axial alignment.

FIGS. 12-16 show another alternative base 90 which may be used to help an athlete become proficient at a maneuver called "around the world" in soccer. Around the World is when you juggle the ball up in the air with one foot and bring that same foot all the way around the soccer ball and continue to juggle it without the ball hitting the ground. You can do this going to the inside or outside of the soccer ball. This base 90 would be installed at the proximal end of the first hollow rod 26 of FIGS. 2 and 3, in the place of the base 16 that is shown in those figures.

Figure 14:
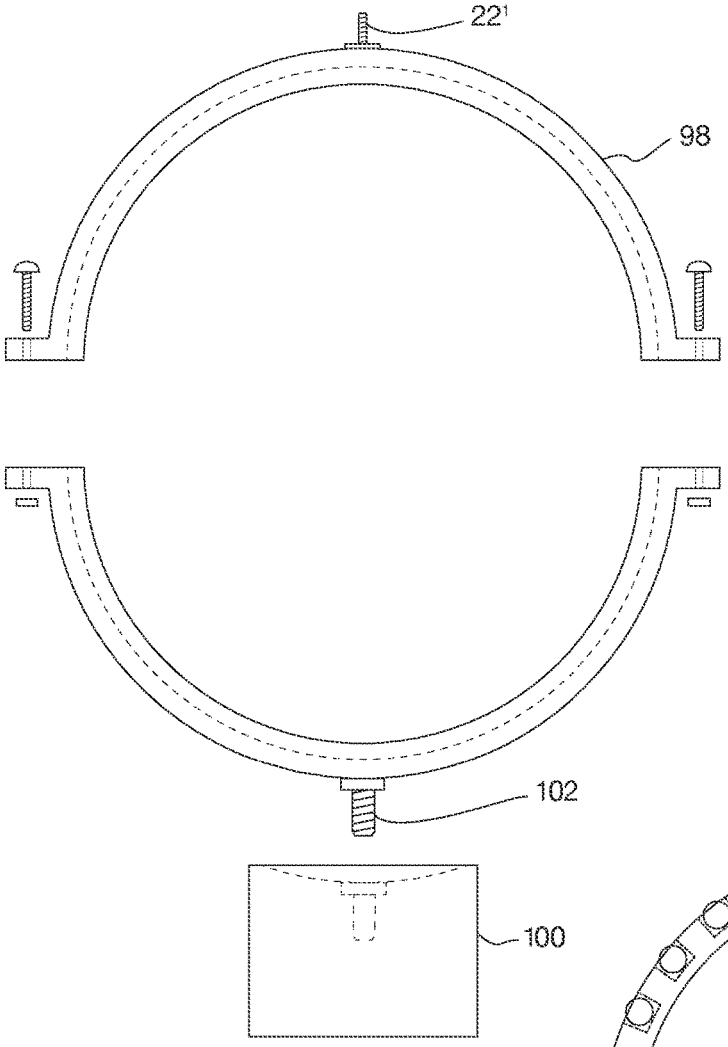
FIG. 14 is an exploded view of the base of FIG. 12.
Figure 14:
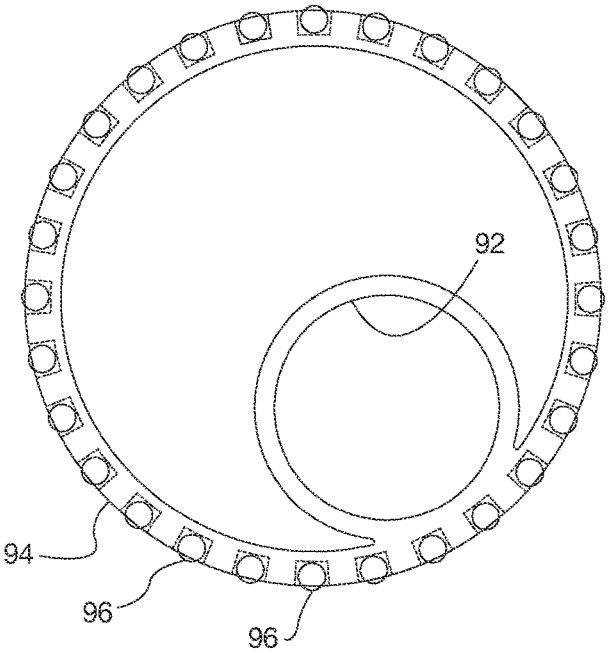
Figure 15:
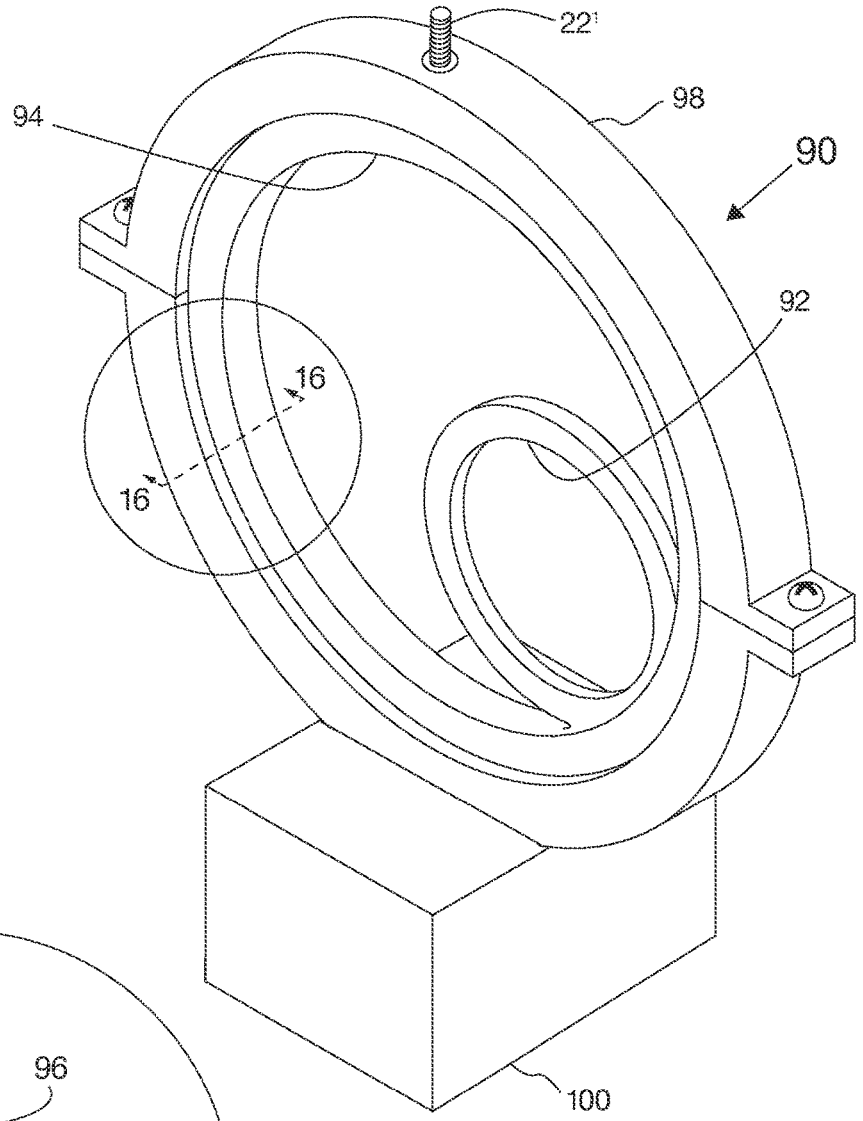
FIG. 15 is a perspective view of the base of FIG. 12.
Figure 16:
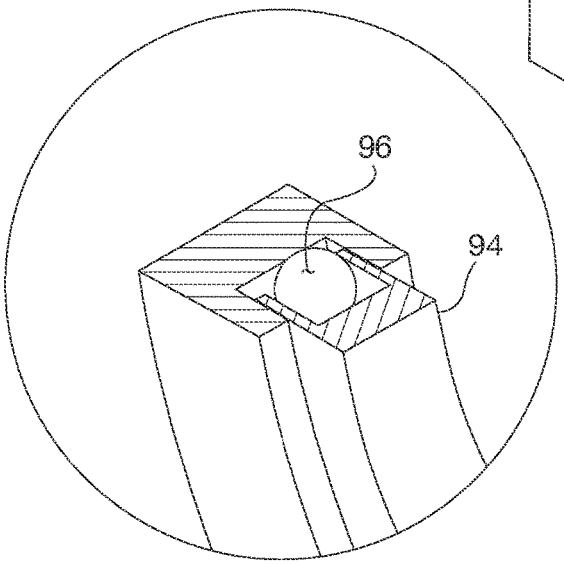
FIG. 16 is an enlarged section view along the line 16-16 of FIG. 15.

Referring to FIGS. 14 and 15, the base 90 is essentially a ball bearing having an outer race 98, an inner race 94, and a plurality of roller elements 96 between the inner race 94 and the outer race 98, as is well known in the bearing manufacturing field. A ring 92 is secured to the inner surface of the inner race 94 for receiving the athlete's foot. A bolt 22' (akin to the bolt 22 on the base 16, See FIG. 3) is secured at the top of the outer race 98 to allow the base 90 to be attached to the proximal end of the first hollow rod 26 of FIG. 3 (after removing the base 16) by threading the bolt 22' into the first cap 24.

A counterweight 100 is mounted on the outer surface of the outer race 98 diametrically opposite the bolt 22' via a mounting bolt 102. The purpose of the counterweight 100 is to keep the bolt 22' of the outer race 98 in a substantially upwardly-pointing orientation and to provide something on which to rest the entire training device 10 when the training device 10 with the base 90 is not being used by the athlete.

To use the training device 10 with the base 90, the user inserts his foot through the ring 92 such that the bridge of his foot is in contact with the inner surface of the ring 92. He then lifts his foot up while rotating his leg so that his foot causes the inner race 94 to rotate relative to the outer race 98. The athlete may cause the inner race 94 to rotate completely around inside the outer race 98, with the ring 92 returning to its original position relative to the outer race 98, and the athlete may make several rotations while balancing the ball 14. Again, the level of difficulty of the training device 10 can be adjusted as discussed earlier.

Once you have reached this level of proficiency, you can remove some or all of the weight in the counterweight 100 which allows the ball 14 to rotate fully around the foot, which is a more realistic simulation of the skill required to do the Around the World maneuver.

It will be obvious to those skilled in the art that modifications may be made to the embodiments described above without departing from the scope of the present invention as claimed.

What is claimed is:

1. A device for training an athlete, comprising:

a base adapted to be in contact with a part of the athlete's body;

a first hollow rod defining a first interior surface, said first hollow rod having a proximal end secured to said base and a distal end having a first threaded outer surface;

a first sleeve having an internally-threaded surface threaded onto said first threaded outer surface;

a second hollow rod defining a second interior surface, said second hollow rod having a distal end for securing to an athletic device, and having a proximal end adjacent to the distal end of said first rod, said proximal end of said second rod having a second threaded outer surface;

a second sleeve having an internally-threaded surface threaded onto said second threaded outer surface; and an elastic member extending along inside said first and second interior surfaces and having a proximal end secured to said first hollow rod and a distal end secured to said second hollow rod.

2. A device for training an athlete as recited in claim 1, and further comprising a first flange at the distal end of said first sleeve and a second flange at the proximal end of said second sleeve, facing said first flange.

3. A device for training an athlete as recited in claim 2, wherein, in a first configuration, said first flange lies at the distal end of said first hollow rod and said second flange lies at the proximal end of said second hollow rod, with said first and second flanges abutting each other.

4. A device for training an athlete as recited in claim 3, wherein, in a second configuration, one of said first and second sleeves is in a retracted position, and the other of said first and second sleeves is in a bridging position, being threaded onto both said first and second threaded outer surfaces.

5. A device for training an athlete as recited in claim 4, wherein, in a third configuration, both said first and second sleeves are in a retracted position and the distal end of the first hollow rod abuts the proximal end of the second hollow rod.

6. A device for training an athlete as recited in claim 5, wherein said base includes a curved frame with straps for strapping said base to a human body part, such as a thigh, arm, or head.

7. A device for training an athlete as recited in claim 6, wherein a cradle for securing a ball is mounted at the distal end of said second hollow rod.

8. A device for training an athlete as recited in claim 5, wherein said base is a golf club grip.

9. A device for training an athlete as recited in claim 8, wherein a golf club head is secured at the distal end of said second hollow rod.

10. A device for training an athlete as recited in claim 5, wherein said base comprises a bearing including an outer race; an inner race; a plurality of rolling elements between said inner race and said outer race; and an inner ring fixed to said inner race, said inner ring being sized to receive a human foot.

11. A device for training an athlete as recited in claim 10, and further comprising a counterweight fixed to said outer race opposite said first hollow rod.

12. A device for training an athlete as recited in claim 10, wherein a cradle for securing a ball is mounted at the distal end of said second hollow rod.

* * * * *